US010948218B2

(12) United States Patent
Nett et al.

(10) Patent No.: US 10,948,218 B2
(45) Date of Patent: Mar. 16, 2021

(54) FULLY-WETTED, REFRACTORY-FREE TUBELESS FLUID HEATING SYSTEM WITH NEGLIGIBLE THERMAL EXPANSION STRESS

(71) Applicant: Fulton Group N.A., Inc., Pulaski, NY (US)

(72) Inventors: Carl Nicholas Nett, Sandisfield, MA (US); Keith Richard Waltz, Sandy Creek, NY (US)

(73) Assignee: FULTON GROUP N.A., INC., Pulaski, NY (US)

( * ) Notice: Subject to any disclaimer, the term of this patent is extended or adjusted under 35 U.S.C. 154(b) by 60 days.

(21) Appl. No.: 16/361,423

(22) Filed: Mar. 22, 2019

(65) Prior Publication Data

US 2019/0219302 A1 Jul. 18, 2019

Related U.S. Application Data

(62) Division of application No. 14/949,990, filed on Nov. 24, 2015, now Pat. No. 10,240,813.

(Continued)

(51) Int. Cl.
*F24H 1/14* (2006.01)
*F28D 7/00* (2006.01)

(Continued)

(52) U.S. Cl.
CPC ..... *F24H 1/145* (2013.01); *F28D 7/0058* (2013.01); *F28D 7/026* (2013.01); *F28D 7/06* (2013.01); *F28D 7/12* (2013.01); *F28F 2265/26* (2013.01)

(58) Field of Classification Search
None
See application file for complete search history.

(56) References Cited

U.S. PATENT DOCUMENTS 1,977,809 A * 10/1934 Sutter ..... B60H 1/18 165/154
3,623,948 A * 11/1971 Dotson ..... G21C 1/08 376/352

(Continued)

FOREIGN PATENT DOCUMENTS

JP 2008232477 A * 10/2008
WO WO-2014131093 A2 * 9/2014 ..... F28D 7/005

OTHER PUBLICATIONS

JP2008232477A—machine translation (Year: 2008).*

*Primary Examiner* — Nathaniel Herzfeld
(74) *Attorney, Agent, or Firm* — McCormick, Paulding & Huber PLLC

(57) ABSTRACT

A method for heating a production fluid in a fluid heating system includes receiving the production fluid by a pressure vessel, the pressure vessel arranged to receive the production fluid and to provide heated production fluid, receiving a thermal transfer fluid by a tubeless heat exchanger core, the tubeless heat exchanger core disposed at least partially within the vessel, the tubeless heat exchanger core comprising an inner casing and an outer casing disposed around the inner casing, the inner and outer casings defining therebetween a flow passage for a thermal transfer fluid to flow, the tubeless heat exchanger core further comprising a core inlet and a core outlet, and at least one of the core inlet and core outlet being disposed on the inner casing, and wherein the flow passage guides the flow of the thermal transfer fluid from the core inlet to the core outlet and wherein at least a portion of respective outer surfaces of the inner and outer casings are arranged to be contacted by the production fluid, and transferring heat from the thermal transfer fluid to the production fluid through at least a portion of both the inner and outer casings.

53 Claims, 5 Drawing Sheets

Related U.S. Application Data

(60) Provisional application No. 62/124,502, filed on Dec. 22, 2014, provisional application No. 62/124,235, filed on Dec. 11, 2014.

(51) Int. Cl.
*F28D 7/02* (2006.01)
*F28D 7/06* (2006.01)
*F28D 7/12* (2006.01)

(56) References Cited

U.S. PATENT DOCUMENTS

| | | | | |
|---|---|---|---|---|
| 4,148,355 | A * | 4/1979 | Gehring | F24D 17/001 165/286 |
| 5,950,716 | A * | 9/1999 | Appelquist | F28D 7/106 165/109.1 |
| 2008/0128526 | A1* | 6/2008 | Otake | F28F 3/12 237/2 B |
| 2015/0369516 | A1* | 12/2015 | Croon | F28D 1/0213 122/18.3 |

* cited by examiner

FULLY-WETTED, REFRACTORY-FREE TUBELESS FLUID HEATING SYSTEM WITH NEGLIGIBLE THERMAL EXPANSION STRESS

CROSS REFERENCE TO RELATED APPLICATIONS

This application is a divisional of U.S. patent application Ser. No. 14/949,990, filed on Nov. 24, 2015, which claims priority to U.S. Provisional Patent Application Ser. No. 62/124,502, filed on Dec. 22, 2014, and U.S. Provisional Patent Application Ser. No. 62/124,235, filed on Dec. 11, 2014, the entire disclosure of each application above are incorporated herein by reference to the extent permitted by applicable law.

BACKGROUND

Field of the Disclosure

This application relates to a fully-wetted, refractory-free tubeless fluid heating system with negligible thermal expansion stress.

Description of Related Art

Fluid heating systems are used to provide a heated production fluid for a variety of commercial, industrial, and domestic applications such as hydronic, steam, and thermal fluid boilers, for example. Because of the desire for improved energy efficiency, compactness, reliability, and cost reduction, there remains a need for improved fluid heating systems, as well as improved methods of manufacture thereof.

SUMMARY

Disclosed is a fluid heating system including: a pressure vessel shell including a first inlet and first outlet; a tubeless heat exchanger core disposed entirely in the pressure vessel shell, the tubeless heat exchanger core including a second inlet and a second outlet; an outlet member, which penetrates the pressure vessel shell and which connects the second outlet of the tubeless heat exchanger core and an outside of the pressure vessel shell; and a conduit having a first end connected to the second inlet of the tubeless heat exchanger core and a second end disposed on the outside of the pressure vessel shell.

Also disclosed is a method for heating a production fluid in a fluid heating system which includes receiving the production fluid by a pressure vessel, the pressure vessel arranged to receive the production fluid and to provide heated production fluid, receiving a thermal transfer fluid by a tubeless heat exchanger core, the tubeless heat exchanger core disposed at least partially within the vessel, the tubeless heat exchanger core comprising an inner casing and an outer casing disposed around the inner casing, the inner and outer casings defining therebetween a flow passage for a thermal transfer fluid to flow, the tubeless heat exchanger core further comprising a core inlet and a core outlet, and at least one of the core inlet and core outlet being disposed on the inner casing, and wherein the flow passage guides the flow of the thermal transfer fluid from the core inlet to the core outlet and wherein at least a portion of respective outer surfaces of the inner and outer casings are arranged to be contacted by the production fluid, and transferring heat from the thermal transfer fluid to the production fluid through at least a portion of both the inner and outer casings.

Also disclosed is a method of heat transfer, the method including: providing a fluid heating system including a pressure vessel shell including a first inlet and first outlet, a tubeless heat exchanger core entirely disposed in the pressure vessel shell, the tubeless heat exchanger core including a second inlet and a second outlet, an outlet member, which penetrates the pressure vessel shell and which connects the second outlet of the tubeless heat exchanger core and an outside of the pressure vessel shell, and a conduit having a first end connected to the second inlet of the tubeless heat exchanger core and a second end disposed on the outside of the pressure vessel shell; and disposing a thermal transfer fluid in the tubeless heat exchanger core and a production fluid in the pressure vessel shell to transfer heat from the thermal transfer fluid to the production fluid.

Also disclosed is a method of manufacturing a fluid heating system, the method including: providing a pressure vessel shell including a first inlet and a first outlet; disposing a tubeless heat exchanger core entirely in the pressure vessel shell, the tubeless heat exchanger core including a second inlet and a second outlet; connecting the second inlet of the tubeless heat exchanger core to a conduit, which penetrates an end of the pressure vessel shell; and connecting a first end of an outlet member to the second outlet of the tubeless heat exchanger core and disposing a second opposite end of the outlet member on an outside of the pressure vessel shell to manufacture the fluid heating system.

Also disclosed is a fluid heating system including: a pressure vessel shell including a first inlet and first outlet, a cylindrical shell, a first top head and a first bottom head, wherein the cylindrical shell is disposed between the first top head and the first bottom head, and wherein the first inlet and the first outlet are each independently on the cylindrical shell, the first top head, or the first bottom head; a tubeless heat exchanger core entirely disposed in the pressure vessel shell, the tubeless heat exchanger core including a cylindrical inner casing, a cylindrical outer casing, a rib disposed between the inner casing and the outer casing, a second top head, a second bottom head, second inlet and a second outlet, wherein the cylindrical inner casing is surrounded by the cylindrical outer casing and the cylindrical inner casing, wherein the cylindrical outer casing are both between the second top head and the second bottom head, and wherein the second inlet and the second outlet are each independently on the cylindrical outer casing, the second top head, or the second bottom head; an outlet member connecting the second outlet to an exhaust flue which is disposed on an outside of the pressure vessel shell; a conduit, which penetrates the pressure vessel shell, wherein a first end of the conduit is connected to the second inlet and wherein a second end of the conduit is on the outside of the pressure vessel shell; a burner disposed in the conduit; and a blower, which is in fluid communication with the second end of the conduit.

BRIEF DESCRIPTION OF THE DRAWINGS

The above and other advantages and features of this disclosure will become more apparent by describing in further detail exemplary embodiments thereof with reference to the accompanying drawings, in which.

DETAILED DESCRIPTION

Fluid heating systems are desirably thermally compact, provide a high ratio between the thermal output and the total size of the fluid heating system, and have a design which can be manufactured at a reasonable cost. This is particularly true of heating systems for hydronic (e.g., liquid water), steam, and thermal fluid heating systems designed to deliver a heated production fluid, such as steam, for temperature regulation, domestic hot water, or commercial or industrial process applications. In the fluid heating system, a thermal transfer fluid comprising, e.g., a hot combustion gas, is generated by combustion of a fuel, and then the heat is transferred from the thermal transfer fluid to the production fluid using a heat exchanger.

Tube-and-shell heat exchanger designs suffer a variety of drawbacks. In a tube-and-shell heat exchanger, the heat is transferred from the thermal transfer fluid to a production fluid across the wall surfaces of numerous thin-walled fluid conduits, e.g., tubes having a wall thickness of less than 0.5 centimeters (cm). The tubes are rigidly connected to a tubesheet. Operational factors including thermal stress and corrosion lead to undesirable material failures in the tubes of tube-and-shell heat exchangers, the attachment points of the tubes, and in the tubesheets. Furthermore, when a failure occurs, the fluid heating system is rendered inoperable, and the thin-wall heat exchanger tubes and/or tubesheets are difficult and costly to service or replace, particularly in field installations. Tube-and-shell heat exchangers suffer from thermal stress material failures caused by longitudinal differential thermal expansion of the heated components, e.g., the thermal expansion of the combustor and heat exchanger assembly relative to the thermal expansion of a pressure vessel shell. Material failures in the delicate heat exchanger tubes and other structural components may be induced by rigidly attaching the combustor and heat exchanger assembly to the pressure vessel shell. Available techniques in practice for mitigating thermal stresses in tube-and-shell heat exchangers all have drawbacks. For example, floating head assemblies are complex and are located inside the pressure vessel shell, and thus are difficult to service. Alternatively inclusion of curves and bends in the delicate heat exchanger tubes add compliance but increase the manufacturing cost and material failure risk. Also, compliant elements, e.g., bellows or expansion joints inside the pressure vessel shell, result in poor system and component field serviceability.

Figure 1:
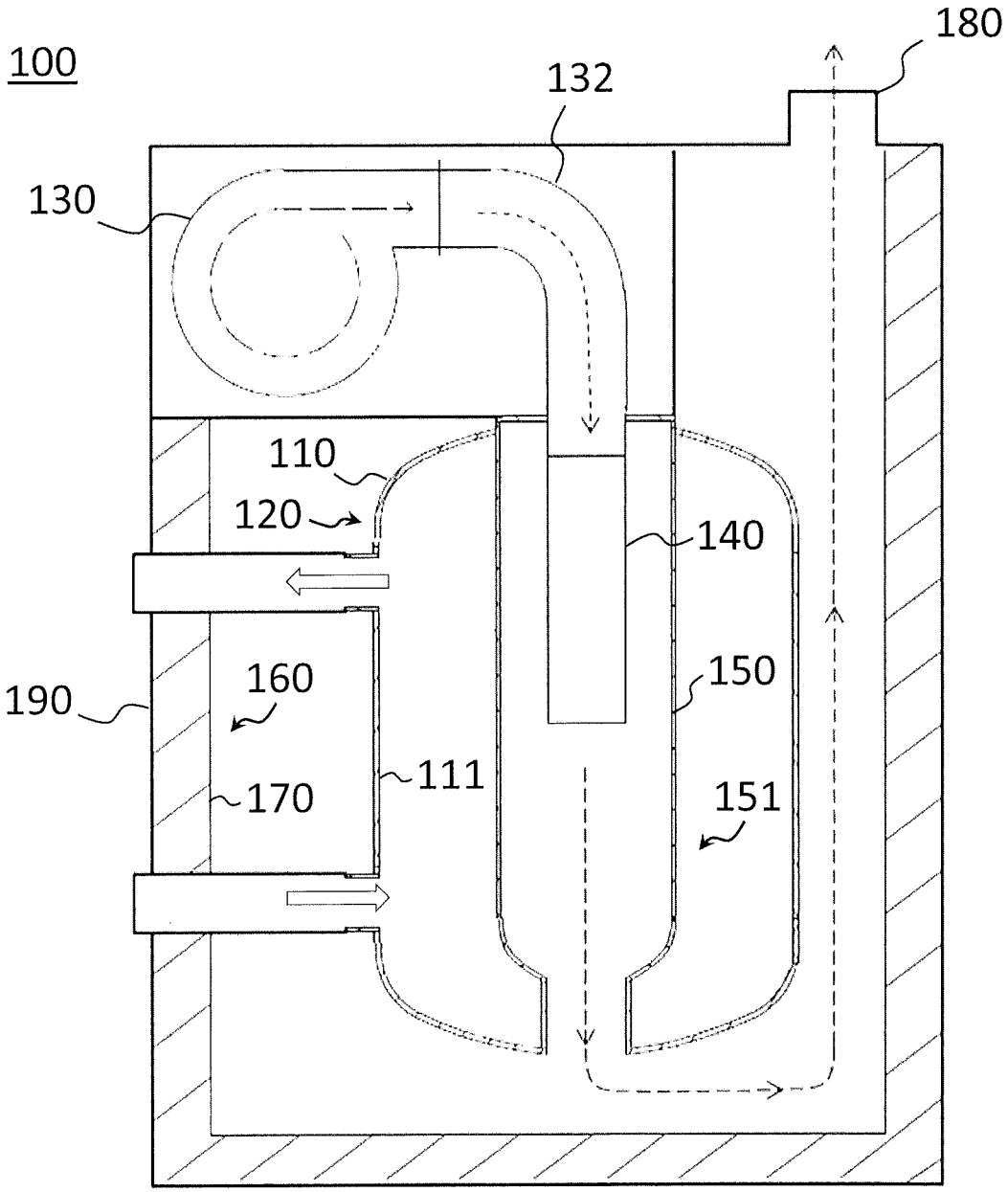
FIG. 1 is a cross-sectional diagram of a fluid heating system comprising a tubeless heat exchanger.

Tubeless heat exchangers are also used. Tubeless heat exchangers avoid the use of the thin-walled tubes and the tubesheets associated with tube- and shell heat exchangers. However, known practical designs for tubeless heat exchangers also have drawbacks. Shown in FIG. 1 is a type of tubeless heat exchanger 100 in which the pressure vessel shell 110 is exposed to a hot combustion gas resulting in a hot surface on the outer surface 120 of the pressure vessel shell 110. As shown in FIG. 1, the blower 130 forces air through a conduit 132 and into a combustor 140. The combustor generates a hot combustion gas, and the hot combustion gas exits the core 150 of the heat exchanger and then contacts the outer surface 120 of the pressure vessel shell 110 and an interior surface 160 of a refractory material layer 170, and then exits the heat exchanger through an outlet port 180. The refractory material layer 170 is disposed on a body cover 190. A production fluid is provided in the pressure vessel shell and contacts an interior surface 111 of the pressure vessel shell 110 and an outer surface 151 of the core 150. Thermal energy is transferred from the hot combustion gas to the heat exchanger core 150 and then to the production fluid and also from the hot combustion gas to the pressure vessel shell 110 and then to the production fluid. As a result, the pressure vessel shell and the refractory material layer are exposed to and can directly contact the combustion gas. A disadvantage of this design is that heat and the combustion gas may be transferred by convection and conduction across the refractory material layer 170 and into the surrounding environment. Also, the core 150, the pressure vessel shell 110, and the refractory material layer 170 can each contact the combustion gas, and thus each is desirably comprised of material which is stable in the presence of the hot combustion gas. Such tubeless designs suffer from refractory deterioration and loss of thermal efficiency due to some amount of heat being transferred into and through cracks in the refractory layer and ultimately into the environment around the heat exchanger. Additionally, flue gas, which can comprise CO, can leak through the cracks in the refractory layer and into occupied areas, instead of flowing to a flue gas discharge stack, creating a health hazard. Furthermore, the hot outer surface of the pressure vessel shell presents safety issues in the event of leaking of the thermal transfer fluid. In addition, the flow passage for the combustion gas is relatively short, contributing to less than desirable thermal efficiency.

Figure 2:
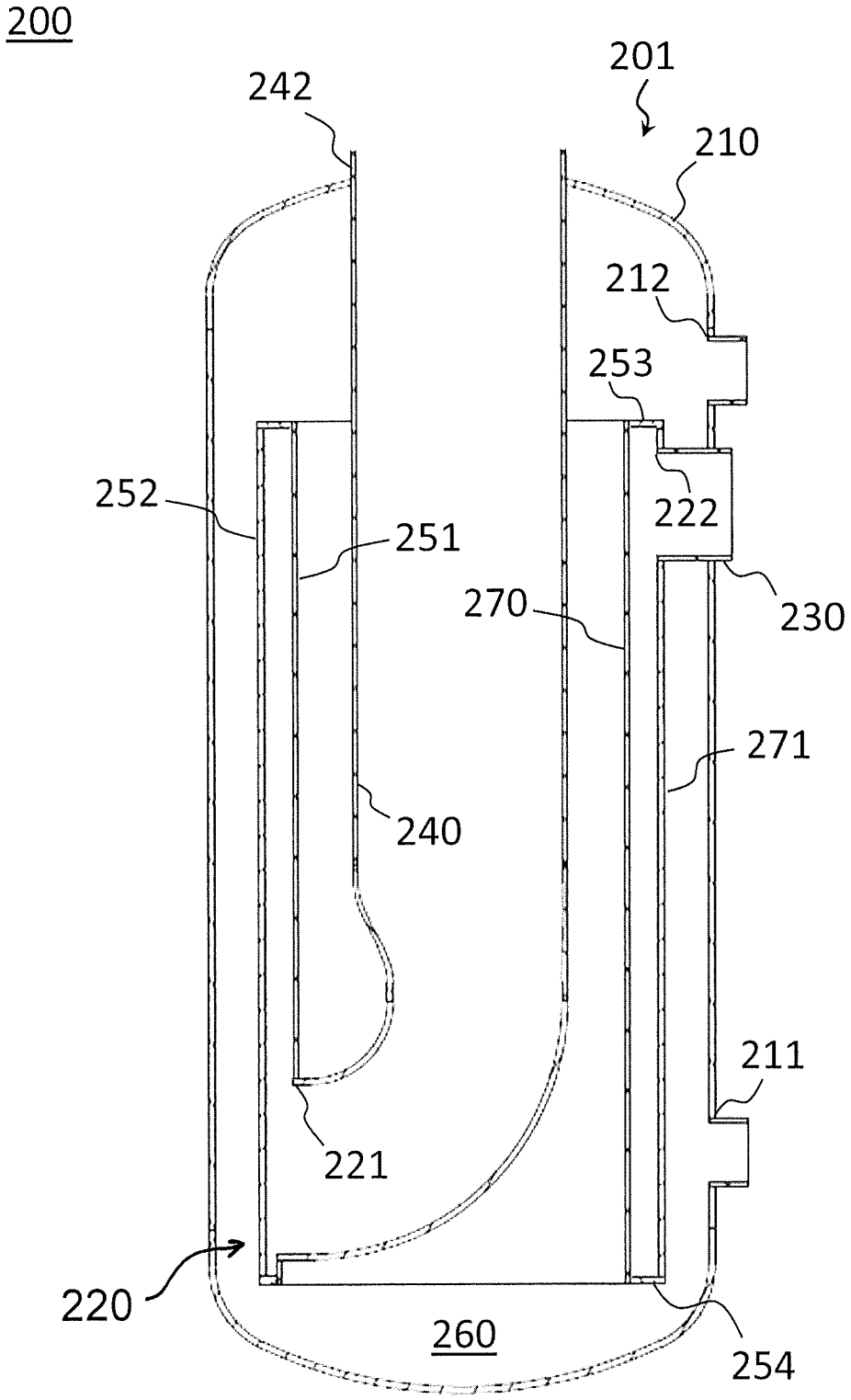
FIG. 2 is a cross-sectional diagram of an embodiment of a tubeless heat exchanger.

Disclosed in FIG. 2 is a tubeless heat exchanger 200 for a fluid heating system, the tubeless heat exchanger comprising: a pressure vessel shell 210 comprising a first inlet 211 and first outlet 212; a tubeless heat exchanger core 220 disposed entirely in the pressure vessel shell, the tubeless heat exchanger core 220 comprising a second inlet 221 and a second outlet 222; an outlet member 230, which penetrates the pressure vessel shell and which connects the second outlet 222 of the tubeless heat exchanger core and an outside of the pressure vessel shell; and a conduit 240 having a first end connected to the second inlet 221 of the tubeless heat exchanger core and a second end 242 disposed on the outside of the pressure vessel shell.

When in use, the pressure vessel shell 210 may be filled with a production fluid, and the heat exchanger core 220 may contain a thermal transfer fluid. The production fluid may be directed from the first inlet 211 to the first outlet 212 of the pressure vessel shell. The thermal transfer fluid may be directed from the conduit 240 through the second inlet 221 and into a flow passage of the tubeless heat exchanger core 220 prior to exiting the heat exchanger core 220 through the second outlet 222 and proceeding through the outlet member 230. The flow passage of the tubeless heat exchanger core is between the second inlet 221 and the second outlet 222 of the heat exchanger core 220, and can be defined by an inner casing 251, an outer casing 252, a top head 253, and a bottom head 254. Thus when the production fluid is directed into the pressure vessel shell, e.g., filling the pressure vessel shell, an entirety of the outer surface of the tubeless heat changer core may be contacted by the production fluid. Also, an entirety of the flow passage of the tubeless heat exchanger core may be disposed entirely within the pressure vessel shell. As is also shown in FIG. 2, an entire outer surface of the heat exchanger core, e.g., outer surfaces of the inner casing 251, the outer casing 252, the top head 253, and the bottom head 254, is contacted by the production fluid, providing for increased surface area of the heat exchanger core which is contacted by the production fluid, resulting in improved thermal efficiency. In an embodiment, 60% to 100%, or 70%, 80%, or 90% to 99%, 98%, or 95% of the outer surface of the heat exchanger core may be contacted by the production fluid, wherein the foregoing upper and lower bounds can be independently combined. Alternatively, 60% to 100%, or 70%, 80%, or 90% to 99%, 98%, or 95% of the heat exchanger core is contained within the pressure vessel shell, wherein the foregoing upper and lower bounds can be independently combined. In a preferred embodiment, 100% of the outer surface of the heat exchanger core is contacted by the production fluid, and an entirety of the heat exchanger core is contained within the pressure vessel shell.

As shown in FIG. 2, the outlet member of the tubeless heat exchanger core and the second end of the conduit are both proximate to a first end 201 of the fluid heating system, and thus the rigid connections between the pressure vessel shell 210 and the heat exchanger core 220 are on a same end of the pressure vessel shell and the heat exchanger core. By providing the rigid connections between the heat exchanger core and the pressure vessel shell on a same end of the heat exchanger core, the heat exchanger core may thermally expand, e.g., downward as shown in FIG. 2, without development of significant thermal stress. This configuration can provide improved durability.

Also provided is a debris region 260, wherein debris, such as corrosion products or precipitates, may collect, thereby avoiding the formation of an accumulation of debris adjacent to a heat transfer surface. While not wanting to be bound by theory, it is understood that an accumulation of debris can form an insulating barrier, resulting in thermal gradients or local hotspots which can lead to material failure. The debris region 260 is disposed between the heat exchanger core 220 and the pressure vessel shell 210. The debris region may be provided in any suitable location, and may be between a top head 253 of the tubeless heat exchanger core and the pressure vessel shell 210, between the outer casing 252 of the tubeless heat exchanger core and the pressure vessel shell 210, between a bottom head 254 of the tubeless heat exchanger core and the pressure vessel shell 210, or a combination thereof. In an embodiment, the debris region is between the bottom head 254 and the pressure vessel shell 210 and distal to the outlet member and the second end of the conduit, as shown in FIG. 2. Alternatively, e.g., when the heat exchanger is in a horizontal configuration, the debris region may be between the second outlet 222 of the heat exchanger core and the first inlet 211 of the pressure vessel shell. Alternatively still, e.g., when the heat exchanger is in a configuration inverted from that shown in FIG. 2, the debris region may be proximate to the second end 242 of the conduit. In a preferred embodiment, the debris region is distal to the outlet member and distal to the second end of the conduit.

Figure 3:
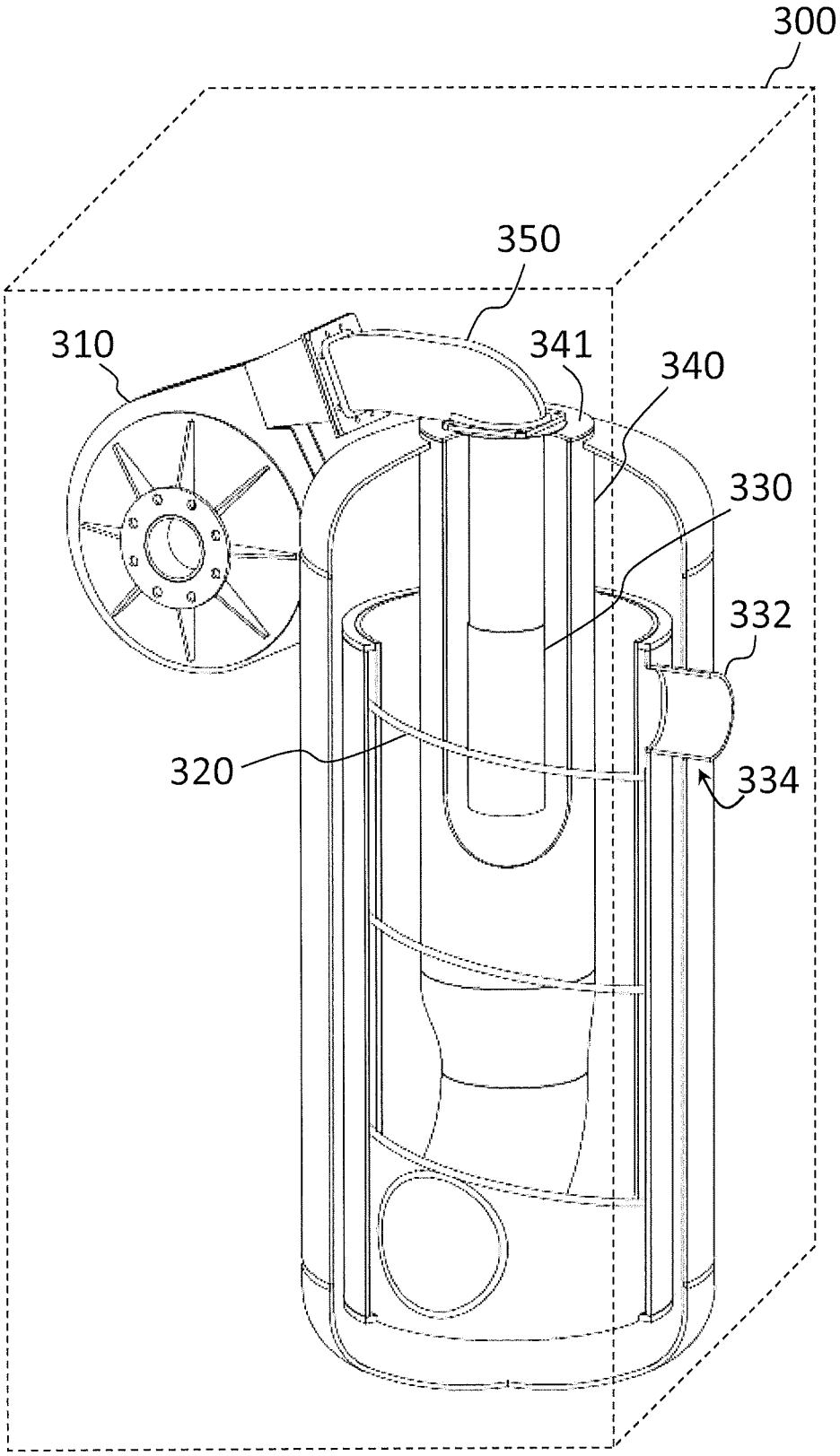
FIG. 3 is a perspective view of an embodiment of a fluid heating system.
Figure 4:
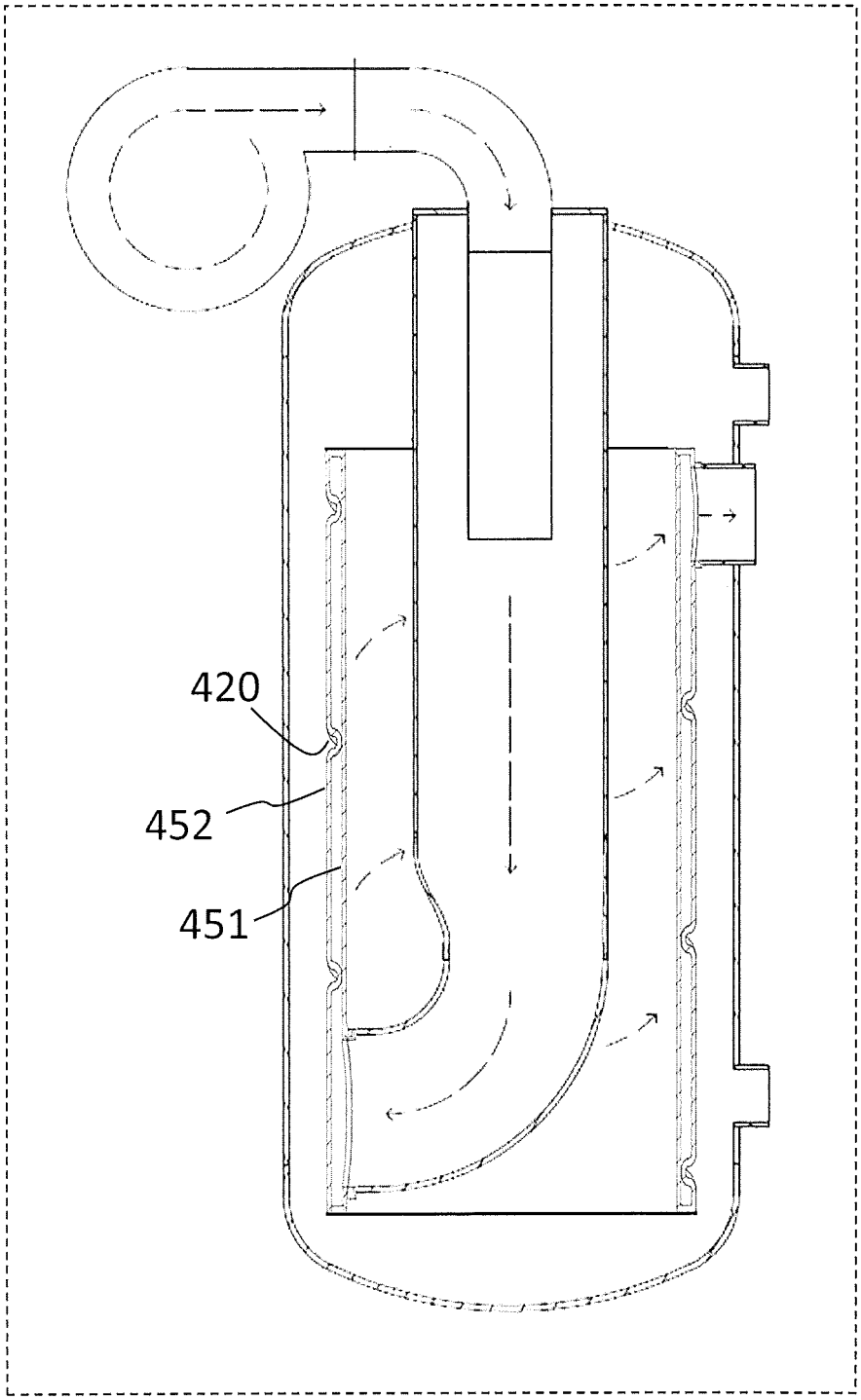
FIG. 4 is a cross-sectional diagram of another embodiment of the fluid heating system.

If desired, the tubeless heat exchanger core can further comprise a flow element, e.g., a rib or a ridge, to direct the flow of the thermal transfer fluid, e.g., to provide a longer path between the inlet and the outlet of the tubeless heat exchanger core. As shown in FIG. 3, a rib 320 is a distinct element that can be disposed between the inner casing and the outer casing of the exchanger core to direct the flow of the thermal transfer fluid between the inlet and the outlet of the heat exchanger core. The rib may be disposed by welding, for example. Alternatively, as shown in FIG. 4, the inner casing 451, the outer casing 452, or combination thereof may be deformed to provide the flow element in the form of a ridge 420. In an embodiment, an average aspect ratio of the flow passage between the inner casing and the outer casing is between 3, 5, 10, 100, 200 or 500, preferably 10 to 100, wherein the aspect ratio is a ratio of a height of the flow passage to a width of the flow passage, wherein the height is a distance between opposite surfaces of neighboring flow elements and is measured normal to a surface of a first flow element and wherein the width of the flow passage is measured from an inner surface of the inner casing to an inner surface of the outer casing, wherein the inner surface of the inner casing and the outer casing are each interior to the flow passage.

Alternatively, a deformation in the inner casing, the outer casing, or combination thereof may be used to provide the flow element. In an embodiment, the tubeless heat exchanger core comprises a top head, a bottom head, an inner casing disposed between the top head and the bottom head, an outer casing disposed between the top head and the bottom head and opposite an inner surface of the inner casing, wherein at least one of the inner casing and the outer casing comprises a ridge 420, wherein the inner casing and the outer casing define a flow passage between the second inlet and the second outlet of the tubeless heat exchanger core, wherein the second inlet of the tubeless heat exchanger core is disposed on the inner casing, the outer casing, or a combination thereof, and wherein the second outlet of the tubeless heat exchanger core is disposed on the inner casing, the outer casing, or a combination thereof. The ridge may be provided by stamping, or hydraulic or pneumatic deformation, for example.

The tubeless heat exchanger core 220 may comprise a top head 253, a bottom head 254, an inner casing 270 disposed between the top head and the bottom head, an outer casing 271 disposed between the top head and the bottom head, wherein an inner surface of the inner casing is opposite an inner surface of the outer casing, a flow element such as a rib 320 disposed between the inner casing and the outer casing, wherein the flow element, the inner casing, and the outer casing define a flow passage between the second inlet and the second outlet of the heat exchanger core, wherein the second inlet of the tubeless heat exchanger core is disposed on the inner casing, the outer casing, or a combination thereof, and wherein the second outlet of the tubeless heat exchanger core is disposed on the inner casing, the outer casing, or a combination thereof.

The second inlet 221 and the second outlet 222 of the heat exchanger core may each independently be on an inner casing 270 or on an outer casing 271 of the heat exchanger core. Also, the second inlet 221 and the second outlet 222 may each independently be proximate or distal to the first end 201 of the fluid heating system, e.g., proximate or distal to the first outlet 212 of the pressure vessel shell. As shown in FIG. 2, in a preferred embodiment, the second inlet 221 is disposed on the inner casing 270 and is distal to the first end of the fluid heating system, and the second outlet 222 is disposed on the outer casing 271 and is proximate to the first and of the fluid heating system.

The inner casing and the outer casing may each have any suitable shape, and may each independently may have a circular cross-sectional shape, an elliptical cross-sectional shape, an oval cross-sectional shape, a stadium cross-sectional shape, a semicircular cross-sectional shape, a square cross-sectional shape, a rectangular cross-sectional shape, a triangular cross-sectional shape, or combination thereof. In a preferred embodiment, the inner casing and the outer casing have a same cross-sectional shape, and in a more preferred embodiment the inner casing and the outer casing each have a circular cross-sectional shape. The inner casing and the outer casing may be coaxial if desired.

The heat exchanger core may have any suitable dimensions. Specifically mentioned is the case where inner casing and the outer casing may each independently have a largest outer diameter of 15 centimeters (cm), 25 cm, 30 cm, 350 cm, 650 cm, or 1,400 cm, wherein the foregoing upper and lower bounds can be independently combined. For example, the inner casing and the outer casing may each independently have a largest outer diameter of 15 cm to 1,400 cm. An embodiment in which the inner casing and the outer casing each independently have a largest outer diameter of 30 cm to 350 cm is preferred.

The inner casing and the outer casing may each independently have a maximum height of 15 centimeters (cm), 25 cm, 30 cm, 350 cm, 650 cm, or 1,400 cm, wherein the foregoing upper and lower bounds can be independently combined. For example, the inner casing and the outer casing may each independently have a maximum height of 15 cm to 1,400 cm. An embodiment in which the inner casing and the outer casing each independently have a largest outer diameter of 30 cm to 650 cm is preferred.

The dimensions of heat exchanger core flow channel are selected based on the required capacity and bulk heat transfer required by the application. In particular, in one aspect the flow channel dimensions are determined to ensure a turbulent flow with Reynolds number between 2500 to 100,000 using standard methods known to those with ordinary skill in the art. Particularly recited are flow channel dimensions that have a hydrodynamic diameter of 1.0 centimeters (cm) to 150 cm, e.g., 1.0 cm, 2.5 cm, 3 cm, 4 cm, or 8 cm to 150 cm, 125 cm, 100 cm, 90 cm, 80 cm, or 70 cm, wherein the foregoing upper and lower bounds can be independently combined. In another embodiment, the heat exchanger core may have an average a hydrodynamic diameter of 2.5 centimeters (cm) to 100 cm, e.g., 2.5 cm, 3 cm, 4 cm, or 8 cm to 100 cm, 90 cm, 80 cm, or 70 cm, wherein the foregoing upper and lower bounds can be independently combined. A flow channel with a hydrodynamic diameter between 2.5 and 100 centimeters is specifically mentioned.

A thickness, e.g., an average thickness, of the top head, the bottom head, the inner casing, and the outer casing may be any suitable dimension, and the thickness of the top head, the bottom head, the inner casing, and the outer casing may each independently be 0.5 cm, 0.6 cm, 0.7 cm, or 1 cm to 5 cm, 4 cm, 3.5 cm, or 3 cm, wherein the foregoing upper and lower bounds can be independently combined. An embodiment in which the top head, the bottom head, the inner casing, and the outer casing each independently have a thickness of 0.5 cm to 1 cm is specifically mentioned.

The top head, the bottom head, the inner casing, the outer casing, the inlet, the outlet, the pressure vessel shell, the inlet member, and the outlet member, can each independently comprise any suitable material. Use of a metal is specifically mentioned. Representative metals include iron, aluminum, magnesium, titanium, nickel, cobalt, zinc, silver, copper, and an alloy comprising at least one of the foregoing. Representative metals include carbon steel, mild steel, cast iron, wrought iron, stainless steel (e.g., a 304, 316 or 400 series stainless steel including 439 stainless steel), Monel, Inconel, bronze, and brass. Specifically mentioned is an embodiment in which the heat exchanger core and the pressure vessel shell each comprise steel.

As shown in FIG. 3, the fluid heating system may further comprise a body cover 300 disposed on the pressure vessel shell. The body cover may have any suitable dimensions, and may have dimensions suitable to contain the pressure vessel shell and a blower 310, as shown in FIG. 3. In an embodiment, the body cover surrounds at least a top surface and a side surface of the pressure vessel shell. If desired, the body cover may be disposed on a top surface of the pressure vessel shell and on a front surface, a rear surface, a left-side surface, and a right-side surface. In an embodiment, the body cover may further be on a bottom of the pressure vessel shell if desired. The body cover may have any suitable shape and may be curvilinear, rectilinear, or combination thereof. If desired, the body cover may have a circular cross-sectional shape, an elliptical cross-sectional shape, an oval cross-sectional shape, a stadium cross-sectional shape, a semicircular cross-sectional shape, a square cross-sectional shape, a rectangular cross-sectional shape, a triangular cross-sectional shape, or combination thereof. A rectangular body cover is specifically mentioned.

The heat exchanger core, the pressure vessel shell, and the body cover 300 may each independently comprise any suitable material, and may comprise a metal such as iron, aluminum, magnesium, titanium, nickel, cobalt, zinc, silver, copper, and an alloy comprising at least one of the foregoing. Representative metals include carbon steel, mild steel, cast iron, wrought iron, stainless steel (e.g., 304, 316 or 439 stainless steel), Monel, Inconel, bronze, and brass. Specifically mentioned is an embodiment in which the heat exchanger core, the pressure vessel shell, and the body cover each comprise mild steel.

In an embodiment, the heat exchanger core consists of the inner casing, the outer casing, the top head, the bottom head, the inlet, and the outlet. When the pressure vessel shell is in use, i.e., filled with a production fluid, because the entire outer surfaces of the heat exchanger core can contact the production fluid, a large surface area for heat transfer can be provided, improving thermal efficiency.

Another advantage of the disclosed fluid heating system is the relatively low temperature of the outer surface of the pressure vessel shell and the avoidance of a high temperature on the outer surface of the pressure vessel shell. When the thermal transfer fluid, which can have a temperature of 200° C. to 1800° C., such as 10° C., 50° C., 100° C., 200° C., or 400° C. to 1800° C., 1600° C., 1400° C., 1200° C., or 1000° C., is disposed, e.g., urged or pumped, through the tubeless heat exchanger core, the thermal transfer fluid does not directly contact the pressure vessel shell. While not wanting to be bound by theory, it is understood that because the heat exchanger core, and thus the flow passage between the inner casing and the outer casing for the thermal transfer fluid, is contained entirely within the pressure vessel shell, and because the entire outer surface of the heat exchanger core is contacted by the production fluid, and because the thermal transfer fluid does not directly contact the pressure vessel shell, and because the exhaust thermal transfer fluid is not conveyed to the flue in the space between the pressure vessel outer surface and the body cover or body cover lined with an insulation material, a high temperature on a surface of the pressure vessel shell is avoided. In an embodiment, a temperature of the surface of the pressure vessel shell may be 20° C. to 400° C., e.g., 40° C. to 100° C., and may be 30° C., 50° C., 60° C., 70° C. or 80° C. to 200° C., 190° C., 180° C., 170° C., 220° C., 300° C., or 400° C., wherein the foregoing upper and lower bounds can be independently combined. Also, an average temperature of the surface of the pressure vessel shell may be 20° C. to 400° C., e.g., 50° C. to 200° C., and may be 30° C., 50° C., 60° C., 70° C. or 80° C. to 200° C., 190° C., 180° C., 170° C., 220° C., 300° C., or 400° C., wherein the foregoing upper and lower bounds can be independently combined. In a preferred embodiment, an average temperature of the surface of the pressure vessel shell is 40° C. to 220° C., preferably 100° C. to 220° C.

Also, because the temperature of the outer surface of the pressure vessel shell is relatively lows, the use of insulation, e.g., a refractory material, between the pressure vessel shell and the body cover can be reduced or omitted altogether if desired. In an embodiment, an insulating material, e.g., a refractory material, between the pressure vessel shell and the body cover may have maximum thickness less than 3 cm, e.g., 1 cm to 3 cm, and selected to provide that the temperature of the outer surface of the body cover is maintained below 65° C., below 40° C., or at 20° C. to 50° C. when the heating system is operating at full operating capacity.

The fluid heating system may be used to exchange heat between any suitable fluids, i.e., a first fluid and the second fluid, wherein the first and second fluids may each independently be a gas or a liquid. Thus the disclosed fluid heating system may be used as a gas-liquid, liquid-liquid, or gas-gas heat exchanger. In a preferred embodiment the first fluid, which is directed through the heat exchanger core, is a thermal transfer fluid, and may be a combustion gas, e.g., a gas produced by fuel fired combustor, and may comprise water, carbon monoxide, carbon dioxide, or combination thereof. Also, the second fluid, which is directed through the pressure vessel and contacts an entire outer surface of the heat exchanger core, is a production fluid and may comprise water, steam, oil, a thermal fluid (e.g., a thermal oil), or combination thereof. The thermal fluid may comprise water, a C2 to C30 glycol such as ethylene glycol, a unsubstituted or substituted C1 to C30 hydrocarbon such as mineral oil or a halogenated C1 to C30 hydrocarbon wherein the halogenated hydrocarbon may optionally be further substituted, a molten salt such as a molten salt comprising potassium nitrate, sodium nitrate, lithium nitrate, or a combination thereof, a silicone, or a combination thereof. Representative halogenated hydrocarbons include 1,1,1,2-tetrafluoroethane, pentafluoroethane, difluoroethane, 1,3,3,3-tetrafluoropropene, and 2,3,3,3-tetrafluoropropene, e.g., chlorofluorocarbons (CFCs) such as a halogenated fluorocarbon (HFC), a halogenated chlorofluorocarbon (HCFC), a perfluorocarbon (PFC), or a combination thereof. The hydrocarbon may be a substituted or unsubstituted aliphatic hydrocarbon, a substituted or unsubstituted alicyclic hydrocarbon, or a combination thereof. Commercially available examples include Therminol® VP-1, (Solutia Inc.), Diphyl® DT (Bayer A. G.), Dowtherm® A (Dow Chemical) and Therm® S300 (Nippon Steel). The thermal fluid can be formulated from an alkaline organic and inorganic compounds. Also, the thermal fluid may be used in a diluted form, for example with concentrations ranging from 3 weight percent to 10 weight percent. An embodiment in which the thermal transfer fluid is a combustion gas and comprises liquid water, steam, or a combination thereof and the production fluid comprises liquid water, steam, a thermal fluid, or a combination thereof is specifically mentioned.

The thermal transfer fluid may be a product of combustion from a hydrocarbon fuel such as natural gas, propane, or diesel, for example. The combustion may be supported with a blower 310, which directs an oxidant, such as air, optionally via a duct 350, into a burner assembly 330, which can be disposed in a conduit 340. The conduit 340 can be disposed between a second inlet 221 of the heat exchanger core 220 and the blower 310, and can contain the burner assembly 330 to provide a furnace comprising the conduit and the burner assembly. Alternatively, the burner assembly can be located between the blower 310 and the conduit 340, e.g., in the duct 350. The combustion gases can be channeled through the conduit 340 of the furnace to the inlet 221 of the heat exchanger core 220, and then directed through the flow passage from the inlet to the outlet of the heat exchanger core. The combustion gases can exit the outlet of the heat exchanger core through the second outlet 222, and then flow into an exhaust manifold prior to being directed into an exhaust flue which is disposed outside of the body cover. The combustion gas may be generated by directing a combustible mixture into the burner assembly and combusting the combustible mixture to produce the combustion gas. If desired, the combustible mixture may be pressurized with a blower 310, which is in fluid communication with the second end of the conduit.

The pressure drop across the heat exchanger is measured as the difference in a first pressure determined at the first end 341 of the conduit 340 compared to a second pressure determined at the second outlet 222 where the thermal transfer fluid enters the outlet member 230. The first pressure and the second pressure can be determined by measurement or calculation. The pressure drop across the heat exchanger can be 0.1 kiloPascals (kPa) to 50 kPa, e.g., 0.1 kPa, 0.5 kPa, 1 kPa, 2 kPa, 3 kPa, 4 kPa, 5 kPa, 6 kPa 7 kPa, 8 kPa, or 9 kPa to 50 kPa, 40 kPa, 35 kPa 25 kPa, 15 kPa or 10 kPa, wherein the foregoing upper and lower bounds can be independently combined. An embodiment in which pressure drop between the first end 341 of the conduit 340 and an outer end of the outlet member 334 is 0.5 kPa to 40 kPa is specifically mentioned.

Figure 5:
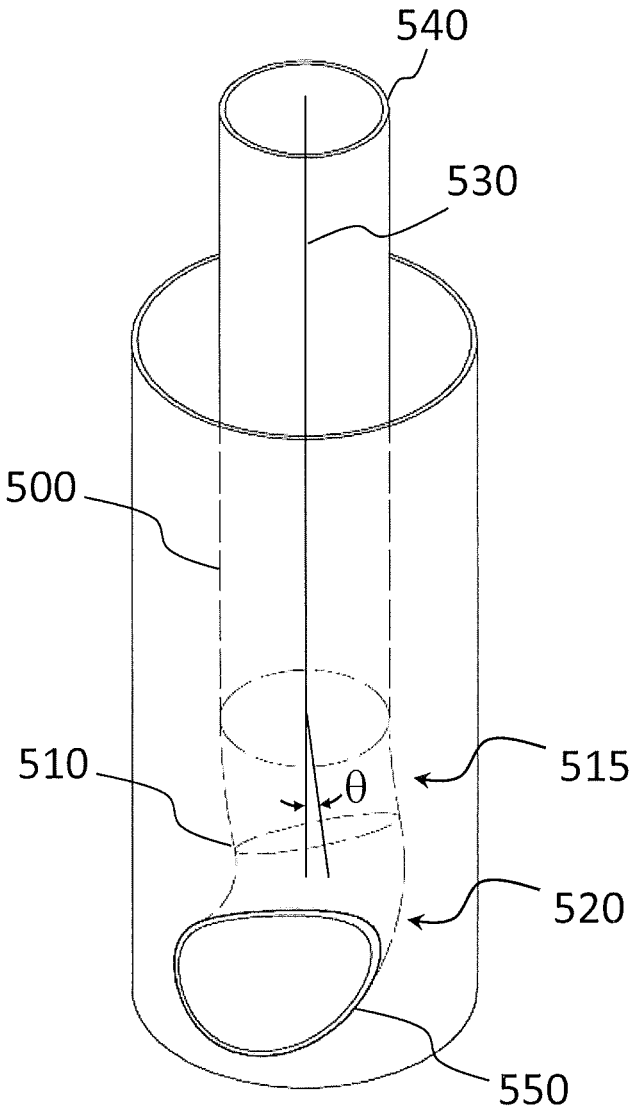
FIG. 5 is a perspective view of an embodiment of a heat exchanger core.

It has also been surprisingly discovered that if the conduit comprises an elbow comprising a first turn and a second turn, improved performance can be provided. While not want to be bound by theory, it is believed that turning the flow of the thermal transfer fluid prior to its entry into the heat exchanger core reduces turbulence, resulting in improved performance. The conduit 500 can comprise an elbow 510 comprising a first turn 515 and a second turn 520, as shown in FIG. 5. The first turn can comprise an angle $\theta^1$ of 5 degrees to 45 degrees, or 5 degrees, 10 degrees, or 15 degrees to 90 degrees, 85 degrees, 65 degrees, 45 degrees, 40 degrees, or 35 degrees, wherein the foregoing upper and lower bounds can be independently combined, relative to a direction of an axis 5 of the conduit between a first end 540 of the conduit and the first turn 515, and wherein the first turn is in a direction perpendicular to the inlet of the heat exchanger core. The second turn may comprise a compound angle, and the second turn can be in a direction from the first turn 515 to the inlet 550 of the heat exchanger core. In an embodiment, the conduit 500 intersects the inlet 550 of the heat exchanger core at angle of 85 degrees to 10 degrees, or 85 degrees, 80 degrees, or 75 degrees to 45 degrees, 40 degrees, 35 degrees, 20 degrees, or 10 degrees, wherein the foregoing upper and lower bounds can be independently combined relative to a tangent of the inlet.

Also disclosed is a method of heat transfer, the method comprising: providing a fluid heating system comprising a pressure vessel shell comprising a first inlet and first outlet, a tubeless heat exchanger core entirely disposed in the pressure vessel shell, the tubeless heat exchanger core comprising a second inlet and a second outlet, an outlet member, which penetrates the pressure vessel shell and which connects the second outlet of the tubeless heat exchanger core and an outside of the pressure vessel shell, and a conduit having a first end connected to the second inlet of the tubeless heat exchanger core and a second end disposed on the outside of the pressure vessel shell; and disposing a thermal transfer fluid in the tubeless heat exchanger core and a production fluid in the pressure vessel shell to transfer heat from the thermal transfer fluid to the production fluid. The disposing of the thermal transfer fluid into the tubeless heat exchanger core may be conducted by directing a combustion gas into the heat exchanger core using a blower, for example. The method of heat transfer may comprise directing the thermal transfer fluid from the first inlet to the first outlet to provide a flow of the thermal transfer fluid through the pressure vessel shell, and directing the production fluid from the second inlet to the second outlet to provide a flow of the production fluid through a flow passage of the tubeless heat exchanger core. The directing and may be provided using a pump, for example.

Also disclosed is method of manufacturing a fluid heating system, the method comprising: providing a pressure vessel shell comprising a first inlet and a first outlet; disposing a tubeless heat exchanger core entirely in the pressure vessel shell, the tubeless heat exchanger core comprising a second inlet and a second outlet; connecting the second inlet of the tubeless heat exchanger core to a conduit, which penetrates an end of the pressure vessel shell; and connecting a first end of an outlet member to the second outlet of the tubeless heat exchanger core and disposing a second opposite end of the outlet member on an outside of the pressure vessel shell to manufacture the fluid heating system.

The second inlet and the second outlet may each independently be disposed on the inner casing or on the outer casing of the heat exchanger core. In a preferred embodiment, the second inlet is disposed on the inner casing of the heat exchanger core, and the second outlet is disposed on the outer casing of the heat exchanger core.

The disclosed fluid heating system provides a variety of features. As noted above, the outer surfaces of the top head and the bottom head may also contact the production fluid, further improving heat transfer efficiency. Also, because an entirety of the outer surface of heat exchanger core may be contacted with the production fluid, thermal stress within the heat exchanger core may be reduced, resulting in improved durability. In addition, because the pressure vessel shell does not contact the production fluid, the disclosed heat exchanger avoids an undesirably hot surface on the pressure vessel shell and avoids the need for insulating the hot surface with a refractory material.

In addition, the disclosed fluid heating system provides for a configuration in which the heat exchanger core may thermally expand without development of thermal stress. In an embodiment, the heat exchanger core is rigidly connected to the pressure vessel shell at a single end, and the heat exchanger core can thermally expand and may increase in length without developing stress because the end of the heat exchanger core on which the bottom head is disposed is not rigidly connected to the pressure vessel shell. In an embodiment, rigid connections between the core of the heat exchanger and the pressure vessel shell are disposed at a same end of the core, and thus the core can expand when heated without development of thermal stress, resulting in improved durability.

Thus in the heat exchanger of the disclosed fluid heating system there is no direct contact between the thermal transfer fluid and the production fluid, and the disclosed heat exchanger avoids use of thin-wall tubing, thereby avoiding the inherent fragility and susceptibility to material failure and corrosion of thin-wall tubing. The disclosed heat exchanger can be provided using metal casings having an average wall thickness of 0.5 to 5 cm, e.g., 0.5 cm, 1 cm, or 2 cm to 3 cm, 4 cm, or 5 cm, wherein the foregoing upper and lower bounds can be independently combined. For example, as the primary member between the thermal transfer fluid and the production fluid. In an embodiment, the disclosed heat exchanger avoids tight turnabouts in flow passages for both the thermal transfer fluid and the production fluid, thereby avoiding configurations that would be susceptible to fouling, clogging, and corrosion blockage. In addition, the disclosed heat exchanger provides for improved compactness (i.e., energy density, $kW/m^3$) and improved performance characteristics compared to tube-and-shell heat exchanger alternatives of the same production capability. As is further disclosed herein, in an embodiment of the disclosed heat exchanger, all outer surfaces of the heat exchanger core are contacted by the production fluid, thereby fully utilizing the outer surfaces of the heat exchanger core for thermal energy transfer and avoiding thermal stress in the heat exchanger core. The efficiency of the disclosed design provides for use of less expensive materials and reduced manufacturing complexity.

In any of the foregoing embodiments, the pressure vessel shell can be configured to contain a production fluid such that an entirety of an outer surface of the tubeless heat exchanger core is contacted by the production fluid; and/or an entirety of a flow passage of the tubeless heat exchanger core can be disposed entirely in the pressure vessel shell; and/or the fluid heating system can have a first end and an opposite second end, and the outlet member of the tubeless heat exchanger core and the second end of the conduit can both be proximate to the first end of the fluid heating system; and/or the tubeless heat exchanger core and the pressure vessel shell can define a debris region between heat exchanger core and the pressure vessel shell for debris accumulation; and/or the debris region can be distal to the outlet member and distal to the second end of the conduit; and/or the debris region can be between a top head of the tubeless heat exchanger core and the pressure vessel shell, the outer casing of the tubeless heat exchanger core and the pressure vessel shell, a bottom head of the tubeless heat exchanger core and the pressure vessel shell, or a combination thereof; and/or the second inlet of the tubeless heat exchanger core can be on an outer surface of an inner casing of the heat exchanger core; and/or the heat exchanger core can have a hydrodynamic diameter of 2.5 centimeters to 100 centimeters; and/or the heat exchanger core can have an average hydrodynamic diameter of 2.5 centimeters to 100 centimeters; and/or an aspect ratio of the flow passage can be 10 to 100, wherein the aspect ratio is a ratio of a height of the flow passage to a width of the flow passage, wherein the height is a distance between opposite surfaces of a same rib and is measured normal to a first rib surface, and wherein the width of the flow passage can be measured from an inner surface of the inner casing to an inner surface of the outer casing; and/or at least one of an inner casing and an outer casing of the tubeless heat exchanger core can have a thickness of 0.5 centimeters to 5 centimeters; and/or optionally further comprising a body cover disposed on the pressure vessel shell; and/or the fluid heating system can be configured to have a temperature of an outer surface of the body cover of less than 65° C., wherein a dimension between an outer surface of the pressure vessel and an inner surface of the body cover can be less than 0.3 centimeters; and/or the body cover can surround at least a top surface and a side surface the pressure vessel shell, and wherein a refractory material is not present between the body cover and the pressure vessel shell; and/or the thermal transfer fluid may not contact the pressure vessel shell; and/or the tubeless heat exchanger core may comprise a top head, a bottom head, an inner casing disposed between the top head and the bottom head, an outer casing disposed between the top head and the bottom head and opposite an inner surface of the inner casing, an inlet on the inner casing, the outer casing, or a combination thereof, and an outlet on the inner casing, the outer casing, or combination thereof, wherein at least one of the inner casing and the outer casing may comprise a rib or a ridge, wherein the inner casing and the outer casing define a flow passage between the inlet and the outlet of the tubeless heat exchanger core, wherein the second inlet of the tubeless heat exchanger core is disposed on the inner casing, the outer casing, or a combination thereof, and wherein the second outlet of the tubeless heat exchanger core is disposed on the inner casing, the outer casing, or a combination thereof; and/or the flow passage can be contained entirely within the pressure vessel shell; and/or the inner casing can be coaxial with the outer casing; and/or optionally further comprising a production fluid in the pressure vessel shell and on an outside of the heat exchanger core, wherein the production fluid contacts an entirety of an outer surface of the heat exchanger core, and a thermal transfer fluid in the flow passage of the heat exchanger core, wherein the production fluid and the thermal transfer fluid each independently comprise a liquid, a gas, or a combination thereof; and/or the production fluid and the thermal transfer fluid each independently can comprise water, a substituted or unsubstituted C1 to C30 hydrocarbon, air, carbon dioxide, carbon monoxide, or a combination thereof; and/or the production fluid can comprise liquid water, steam, a thermal fluid, a glycol, or a combination thereof; and/or the conduit can further comprise a burner assembly disposed in the conduit; and/or optionally further comprise a blower in fluid communication with the conduit; and/or a pressure drop between the first end of the conduit and an outlet of the tubeless heat exchanger core can be greater than 3 kiloPascals; and/or the conduit can comprise an elbow comprising a first turn and a second turn; and/or the first turn can comprise an angle of 5 degrees to 60 degrees, relative to a direction of an axis of the conduit between a first end of the conduit and the first turn, and wherein the first turn can be in a direction perpendicular to the inlet of the heat exchanger core; and/or the second turn can comprise a compound angle, and wherein the second turn can be in a direction from the first turn to the inlet of the heat exchanger core; and/or the conduit can intersect the inlet of the heat exchanger core at angle of 85 degrees to 45 degrees, relative to tangent of the inlet; and/or the method can further comprise directing the production fluid from the first inlet to the first outlet to provide a flow of the production fluid through the pressure vessel shell, and directing the thermal transfer fluid from the second inlet to the second outlet to provide a flow of the thermal transfer fluid through a flow passage of the tubeless heat exchanger core; and/or the thermal transfer fluid can comprise liquid water, steam, or a combination thereof; and/or the production fluid can comprise water, a C1 to C10 hydrocarbon, air, carbon dioxide, carbon monoxide, or a combination thereof; and/or optionally further comprising a burner disposed in the conduit; and/or the thermal transfer fluid can be a combustion gas from the burner; and/or optionally further comprising generating the combustion gas by directing a combustible mixture into the burner assembly and combusting the combustible mixture to produce the combustion gas; and/or optionally further comprising pressurizing the combustible mixture with a blower, which is in fluid communication with the second end of the conduit; and/or a temperature of an outer surface of the pressure vessel shell can be less than 165° C.; and/or the second inlet can be disposed on an outer surface of an inner casing of the heat exchanger core.

The invention has been described with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. Also, the element may be on an outer surface or on an inner surface of the other element, and thus "on" may be inclusive of "in" and "on."

It will be understood that, although the terms "first," "second," "third," etc. may be used herein to describe various elements, components, regions, layers, and/or sections, these elements, components, regions, layers, and/or sections should not be limited by these terms. These terms are only used to distinguish one element, component, region, layer, or section from another element, component, region, layer or section. Thus, "a first element," "component," "region," "layer," or "section" discussed below could be termed a second element, component, region, layer, or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes," and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

"Hydrocarbon" means an organic compound having at least one carbon atom and at least one hydrogen atom, wherein one or more of the hydrogen atoms can optionally be substituted by a halogen atom (e.g., $CH_3F$, $CHF_3$ and $CF_4$ are each a hydrocarbon as used herein)

"Substituted" means that the compound is substituted with at least one (e.g., 1, 2, 3, or 4) substituent independently selected from a hydroxyl (—OH), a C1-9 alkoxy, a C1-9 haloalkoxy, an oxo (=O), a nitro ($—NO_2$), a cyano (—CN), an amino ($—NH_2$), an azido ($—N_3$), an amidino (—C(=NH)$NH_2$), a hydrazino ($—NHNH_2$), a hydrazono (=N—$NH_2$), a carbonyl (—C(=O)—), a carbamoyl group (—C(O)$NH_2$), a sulfonyl (—S(=O)$_2$—), a thiol (—SH), a thiocyano (—SCN), a tosyl ($CH_3C6H_4SO_2$—), a carboxylic acid (—C(=O)OH), a carboxylic C1 to C6 alkyl ester (—C(=O)OR wherein R is a C1 to C6 alkyl group), a carboxylic acid salt (—C(=O)OM) wherein M is an organic or inorganic anion, a sulfonic acid ($—SO_3H_2$), a sulfonic mono- or dibasic salt ($—SO_3MH$ or $—SO_3M_2$ wherein M is an organic or inorganic anion), a phosphoric acid ($—PO_3H_2$), a phosphoric acid mono- or dibasic salt ($—PO_3MH$ or $—PO_3M_2$ wherein M is an organic or inorganic anion), a C1 to C12 alkyl, a C3 to C12 cycloalkyl, a C2 to C12 alkenyl, a C5 to C12 cycloalkenyl, a C2 to C12 alkynyl, a C6 to C12 aryl, a C7 to C13 arylalkylene, a C4 to C12 heterocycloalkyl, and a C3 to C12 heteroaryl instead of hydrogen, provided that the substituted atom's normal valence is not exceeded.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

What is claimed is:

1. A method of heat transfer in a fluid heating system, comprising:

providing a pressure vessel shell comprising a vessel inlet arranged to receive a production fluid to be heated and vessel outlet arranged to provide heated production fluid, the pressure vessel shell containing the production fluid to be heated;

providing a tubeless heat exchanger, comprising:

a tubeless heat exchanger core disposed at least partially within the pressure vessel, the tubeless heat exchanger core comprising an inner casing and an outer casing disposed around the inner casing, the inner and outer casings defining therebetween a flow passage for a thermal transfer fluid to flow, the tubeless heat exchanger core further comprising a core inlet arranged to receive the thermal transfer fluid and a core outlet arranged to provide the thermal transfer fluid, the core inlet and core outlet being fluidically connected to the flow passage, and at least one of the core inlet and core outlet being disposed on the inner casing; and wherein each of the outer casing and the inner casing has an inner surface and an outer surface, wherein the respective inner surfaces face each other and define therebetween the flow passage which guides a flow volume of the thermal transfer fluid continuously from the core inlet to the core outlet, the flow volume traversing at least once around a perimeter of the heat exchanger core, and wherein at least a portion of the respective outer surfaces are arranged to be contacted by the production fluid;

disposing the production fluid in the vessel inlet; and disposing the thermal transfer fluid in the core inlet to transfer heat from the thermal transfer fluid to the production fluid through at least a portion of both the inner and outer casings.

2. The method of claim 1, further comprising:

providing an outlet member, which penetrates the pressure vessel shell and which fluidically connects the core outlet through the pressure vessel shell to provide the thermal transfer fluid outside of the pressure vessel shell; and providing a conduit fluidically connected to the heat exchanger core, and arranged to provide the thermal transfer fluid to the heat exchanger core, the conduit having a conduit outlet end fluidically connected to the core inlet and a conduit inlet end arranged to receive the thermal fluid.

3. The method of claim 2, wherein the conduit is configured to provide the thermal transfer fluid from the conduit inlet, along the conduit to the conduit outlet and the core inlet to the flow passage, and wherein the conduit comprises a conduit outer surface, at least a portion of the conduit outer surface also arranged to be contacted by the production fluid.

4. The method of claim 1, wherein the flow passage comprises one or more flow elements, the flow elements comprising at least one of: a rib, a ridge, and a deformation of the inner surface of one or both of the inner casing and the outer casing, to guide the flow of the thermal transfer fluid continuously along the flow passage from the core inlet to the core outlet.

5. The method of claim 4, wherein the one or more flow elements defines a spiral path along the flow passage.

6. The method of claim 1, wherein the pressure vessel shell is configured to contain the production fluid such that substantially all of the outer surfaces of the tubeless heat exchanger core are contacted by the production fluid.

7. The method of claim 1, wherein the fluid heating system has a first end and an opposite second end, and wherein the outlet member of the tubeless heat exchanger core and the conduit inlet end are both proximate to the first end of the fluid heating system.

8. The method of claim 1, further comprising collecting debris in a debris region between heat exchanger core and the pressure vessel shell configured for debris accumulation.

9. The method of claim 8, wherein the debris region is distal to the outlet member and distal to the conduit inlet end.

10. The method of claim 8, wherein the debris region is between at least one of: a top head of the tubeless heat exchanger core and the pressure vessel shell, the outer casing of the tubeless heat exchanger core and the pressure vessel shell, and a bottom head of the tubeless heat exchanger core and the pressure vessel shell.

11. The method of claim 1, wherein the heat exchanger core has a hydrodynamic diameter of 2.5 centimeters to 100 centimeters.

12. The method of claim 1, wherein an aspect ratio of the flow passage of the tubeless heat exchanger core is 10 to 100, wherein the aspect ratio is a ratio of a height of the flow passage to a width of the flow passage, wherein the height is a distance between opposite surfaces of a same flow element and is measured normal to a first flow element surface, and wherein the width of the flow passage is measured from the inner surface of the inner casing to the inner surface of the outer casing.

13. The method of claim 1, wherein at least one of the inner casing and the outer casing of the tubeless heat exchanger core has a thickness of 0.5 centimeters to 5 centimeters.

14. The method of claim 1, further comprising a body cover disposed on the pressure vessel shell.

15. The method of claim 14, wherein the fluid heating system is configured to have a temperature of an outer surface of the body cover of less than 65° C., wherein a dimension between an outer surface of the pressure vessel shell and an inner surface of the body cover is less than 3 centimeters.

16. The method of claim 14, wherein the body cover surrounds at least a top surface and a side surface the pressure vessel shell, and wherein a refractory material is not present between the body cover and the pressure vessel shell.

17. The method of claim 1, wherein the inner casing is coaxial with the outer casing.

18. The method of claim 1, wherein the production fluid contacts substantially all of the outer surfaces of the inner and outer casings of the heat exchanger core, and the production fluid and the thermal transfer fluid each independently comprise a liquid, a gas, or a combination thereof.

19. The method of claim 1, wherein the production fluid and the thermal transfer fluid each independently comprise water, a substituted or unsubstituted C1 to C30 hydrocarbon, air, carbon dioxide, carbon monoxide, or a combination thereof.

20. In the method of claim 1, wherein the production fluid comprises liquid water, steam, a thermal fluid, a glycol, or a combination thereof.

21. The method of claim 2, wherein the conduit further comprises a burner assembly disposed in the conduit.

22. The method of claim 2, further comprising a blower in fluid communication with the conduit.

23. The method of claim 2, wherein a pressure drop between the first end of the conduit and the core outlet is greater than 3 kiloPascals.

24. The method of claim 2, wherein the conduit comprises an elbow comprising a first turn and a second turn.

25. The method of claim 24 wherein the first turn comprises an angle of 5 degrees to 60 degrees, relative to a direction of an axis of the conduit between a first end of the conduit and the first turn, and wherein the first turn is in a direction perpendicular to the core inlet.

26. The method of claim 24, wherein the second turn comprises a compound angle, and wherein the second turn is in a direction from the first turn to the core inlet.

27. The method of claim 2, wherein the conduit intersects the core inlet at angle of 85 degrees to 45 degrees, relative to tangent of the core inlet.

28. The method of claim 1, wherein the thermal transfer fluid does not contact the pressure vessel shell.

29. The method of claim 1, wherein the flow passage is contained entirely within the pressure vessel shell.

30. The method of claim 1, wherein the heat exchanger core comprises a top head and a bottom head, and wherein the inner casing and outer casing are disposed between the top head and the bottom head.

31. The method of claim 1, wherein the inner casing and outer casing are both cylindrical.

32. The method of claim 2, wherein at least a portion of the conduit is coaxial with the tubeless heat exchanger core.

33. The method of claim 2, wherein the outlet member mechanically attaches the core outlet to the pressure vessel shell to provide rigid mechanical support for the heat exchanger core and to minimize longitudinal thermal stresses on the heat exchanger core within the pressure vessel.

34. The method of claim 2, wherein the conduit is mechanically attached to the pressure vessel shell so as to minimize longitudinal thermal stresses on the heat exchanger core within the pressure vessel.

35. The method of claim 1, wherein the core inlet is disposed on the inner casing.

36. The method of claim 1, wherein a temperature of an outer surface of the pressure vessel shell is less than 165° C.

37. A method for heating a production fluid in a fluid heating system, comprising:

receiving the production fluid by a pressure vessel, the pressure vessel comprising a vessel inlet arranged to receive the production fluid to be heated and a vessel outlet arranged to provide heated production fluid, the pressure vessel containing the production fluid to be heated;

receiving a thermal transfer fluid by a tubeless heat exchanger core, the tubeless heat exchanger core disposed at least partially within the vessel, the tubeless heat exchanger core comprising an inner casing and an outer casing disposed around the inner casing, the inner and outer casings defining therebetween a flow passage for the thermal transfer fluid to flow, the tubeless heat exchanger core further comprising a core inlet arranged to receive the thermal transfer fluid and a core outlet arranged to provide the thermal transfer fluid, the core inlet and core outlet being fluidically connected to the flow passage, and at least one of the core inlet and core outlet being disposed on the inner casing; and wherein each of the outer casing and the inner casing has an inner surface and an outer surface, wherein the respective inner surfaces face each other and define therebetween the flow passage which guides a flow volume of the thermal transfer fluid continuously from the core inlet to the core outlet, the flow volume traversing at least once around a perimeter of the heat exchanger core, and wherein at least a portion of the respective outer surfaces are arranged to be contacted by the production fluid; and transferring heat from the thermal transfer fluid to the production fluid through at least a portion of both the inner and outer casings.

38. The method of claim 37, wherein the core inlet is disposed on the inner casing.

39. The method of claim 37, wherein the heat exchanger core is arranged to thermally expand longitudinally within the pressure vessel shell without causing additional longitudinal stresses on the heat exchanger core due to such longitudinal thermal expansion.

40. The method of claim 37, wherein the heat exchanger core is arranged to thermally expand longitudinally within the pressure vessel shell without causing additional stresses on any mechanical connections between the heat exchanger core and the pressure vessel shell due to such longitudinal thermal expansion.

41. The method of claim 37, further comprising providing a conduit fluidically connected to the heat exchanger core, and arranged to provide the thermal transfer fluid to the heat exchanger core, the conduit having a conduit outlet end fluidically connected to the core inlet and a conduit inlet end arranged to receive the thermal transfer fluid, and wherein the conduit inlet is mechanically attached to the pressure vessel shell to minimize longitudinal thermal stresses on the heat exchanger core within the pressure vessel.

42. The method of claim 41, wherein the conduit is configured to provide the thermal transfer fluid from the conduit inlet, along the conduit to the conduit outlet and the core inlet to the flow passage, and wherein the conduit comprises a conduit outer surface, at least a portion of the conduit outer surface also arranged to be contacted by the production fluid.

43. The method of claim 37, wherein the flow passage comprises one or more flow elements, the flow elements comprising at least one of: a rib, a ridge, and a deformation of the inner surface of one or both of the inner casing and the outer casing, to guide the flow of the thermal transfer fluid continuously along the flow passage from the core inlet to the core outlet.

44. The method of claim 43, wherein the one or more flow elements defines a spiral path along the flow passage.

45. The method of claim 37, wherein the heat exchanger core has a hydrodynamic diameter of 2.5 centimeters to 100 centimeters.

46. The method of claim 37, wherein an aspect ratio of the flow passage of the tubeless heat exchanger core is 10 to 100, wherein the aspect ratio is a ratio of a height of the flow passage to a width of the flow passage, wherein the height is a distance between opposite surfaces of a same flow element and is measured normal to a first flow element surface, and wherein the width of the flow passage is measured from the inner surface of the inner casing to the inner surface of the outer casing.

47. The method of claim 37, wherein a temperature of an outer surface of the pressure vessel shell is less than 165° C.

48. A method for transferring heat between a first fluid and a second fluid in a fluid heating system, comprising:

receiving the second fluid by a pressure vessel, the pressure vessel comprising a vessel inlet arranged to receive the second fluid to be heated and a vessel outlet arranged to provide heated second fluid, the pressure vessel containing the second fluid to be heated;

receiving the first fluid by a tubeless heat exchanger core, the tubeless heat exchanger core disposed at least partially within the vessel, the tubeless heat exchanger core comprising an inner casing and an outer casing disposed around the inner casing, the inner and outer casings defining therebetween a flow passage for the first fluid to flow, the tubeless heat exchanger core further comprising a core inlet arranged to receive the first fluid and a core outlet arranged to provide the first fluid, the core inlet and core outlet being fluidically connected to the flow passage, and at least one of the core inlet and core outlet being disposed on the inner casing;

wherein each of the outer casing and the inner casing has an inner surface and an outer surface, wherein the respective inner surfaces face each other and define therebetween the flow passage which provides continuously guided flow of a flow volume of the first fluid from the core inlet to the core outlet, the flow volume traversing at least once around a perimeter of the heat exchanger core, and wherein at least a portion of the respective outer surfaces are arranged to be contacted by the production fluid; and transferring heat from the first fluid to the second fluid through at least a portion of both the inner and outer casings.

49. The method of claim 48, wherein the core inlet is disposed on the inner casing.

50. The method of claim 48, wherein the heat exchanger core has a hydrodynamic diameter of 2.5 centimeters to 100 centimeters.

51. The method of claim 48, wherein an aspect ratio of the flow passage of the tubeless heat exchanger core is 10 to 100, wherein the aspect ratio is a ratio of a height of the flow passage to a width of the flow passage, wherein the height is a distance between opposite surfaces of a same flow element and is measured normal to a first flow element surface, and wherein the width of the flow passage is measured from the inner surface of the inner casing to the inner surface of the outer casing.

52. The method of claim 48, wherein the flow passage comprises one or more flow elements, the flow elements comprising at least one of: a rib, a ridge, and a deformation of the inner surface of one or both of the inner casing and the outer casing, to continuously guide the flow of the thermal transfer fluid along the flow passage from the core inlet to the core outlet.

53. The method of claim 52, wherein the one or more flow elements defines a spiral path along the flow passage.

* * * * *